US007228653B2

(12) United States Patent
Byrne et al.

(10) Patent No.: US 7,228,653 B2
(45) Date of Patent: Jun. 12, 2007

(54) FOOD MIXER WITH ATTACHED RECIPE CARD HOLDING DEVICE

(75) Inventors: Robert M. Byrne, Lima, OH (US); Kurt F. Hafeken, Sr., Elida, OH (US)

(73) Assignee: American Trim, LLC, Lima, OH (US)

( * ) Notice: Subject to any disclaimer, the term of this patent is extended or adjusted under 35 U.S.C. 154(b) by 121 days.

(21) Appl. No.: 10/945,539

(22) Filed: Sep. 20, 2004

(65) Prior Publication Data

US 2005/0050785 A1 Mar. 10, 2005

Related U.S. Application Data

(63) Continuation-in-part of application No. 10/462,378, filed on Jun. 16, 2003, now abandoned.

(60) Provisional application No. 60/389,417, filed on Jun. 17, 2002.

(51) Int. Cl.
*G09F 3/18* (2006.01)

(52) U.S. Cl. ..... 40/649; 40/642.02

(58) Field of Classification Search ..... D7/376, D7/379; 366/349
See application file for complete search history.

(56) References Cited

U.S. PATENT DOCUMENTS

| | | | | |
|---|---|---|---|---|
| 867,808 | A | 10/1907 | Duke | |
| 1,369,760 | A | 2/1921 | King et al. | |
| 3,057,093 | A * | 10/1962 | Gallo | 40/645 |
| 3,057,393 | A | 10/1962 | Clarke | |
| 3,168,276 | A * | 2/1965 | Schneider | 248/467 |
| 3,187,366 | A * | 6/1965 | Fant | 15/246 |
| 4,023,763 | A | 5/1977 | Pulley | |
| 4,277,181 | A * | 7/1981 | Stahly et al. | 366/69 |
| 4,690,285 | A | 9/1987 | Stone | |
| 5,841,373 | A | 11/1998 | Mason | |

FOREIGN PATENT DOCUMENTS

| | | |
|---|---|---|
| GB | 523150 | 7/1940 |

* cited by examiner

*Primary Examiner*—Joanne Silbermann
(74) *Attorney, Agent, or Firm*—Rankin, Hill, Porter & Clark LLP

(57) ABSTRACT

The present invention provides a kitchen appliance that includes a food mixer and a recipe card holding device. The recipe card holding device includes a first end that is attached to the food mixer and a second end that holds a recipe card.

5 Claims, 4 Drawing Sheets

FOOD MIXER WITH ATTACHED RECIPE CARD HOLDING DEVICE

CROSS-REFERENCE TO RELATED APPLICATION

This application is a continuation-in-part of application Ser. No. 10/462,378, filed Jun. 16, 2003 now abandoned.

BACKGROUND OF THE INVENTION

1. Field of Invention

The present invention relates to a kitchen appliance comprising a food mixer having a recipe card holding device attached thereto.

2. Description of Related Art

Recipes, which are sets of written or printed instructions for preparing food items, are frequently recorded on cards such as 3"×5" or 4"×6" index cards and other paper products. Recipes are sometimes printed on or included within the packaging of food ingredients. Recipe cards are also frequently published and sold as sets, which can be stored in recipe card boxes.

A food preparer will often place a recipe card on the food preparation surface during use. The recipe card is thus exposed to spills, which can stain, damage or destroy the card. A recipe card placed on a food preparation surface can also become covered or hidden by ingredients or cookware used during food preparation, which makes it difficult for the food preparer to quickly locate the recipe card.

BRIEF SUMMARY OF THE INVENTION

The present invention provides a food mixer with an attached recipe card holding device. The recipe card holding device has a first end that is attached to the food mixer and a second end that holds a recipe card. In a preferred embodiment of the invention, the first end of the recipe card holding device comprises a mounting portion that is configured to contact the housing of the food mixer adjacent to an accessory power take off. An opening is provided in the mounting portion through which an accessory mounting screw extends to attach the recipe card holding device to the food mixer.

The recipe card holding device according to the invention holds a recipe card in full view of the food preparer in a convenient location. The recipe card is not placed on the food preparation surface and is thus not at risk of being damaged due to spills. The recipe card holding device can be attached and detached from the food mixer quickly and easily without the need for special tools, and can be stored in a drawer when not in use.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
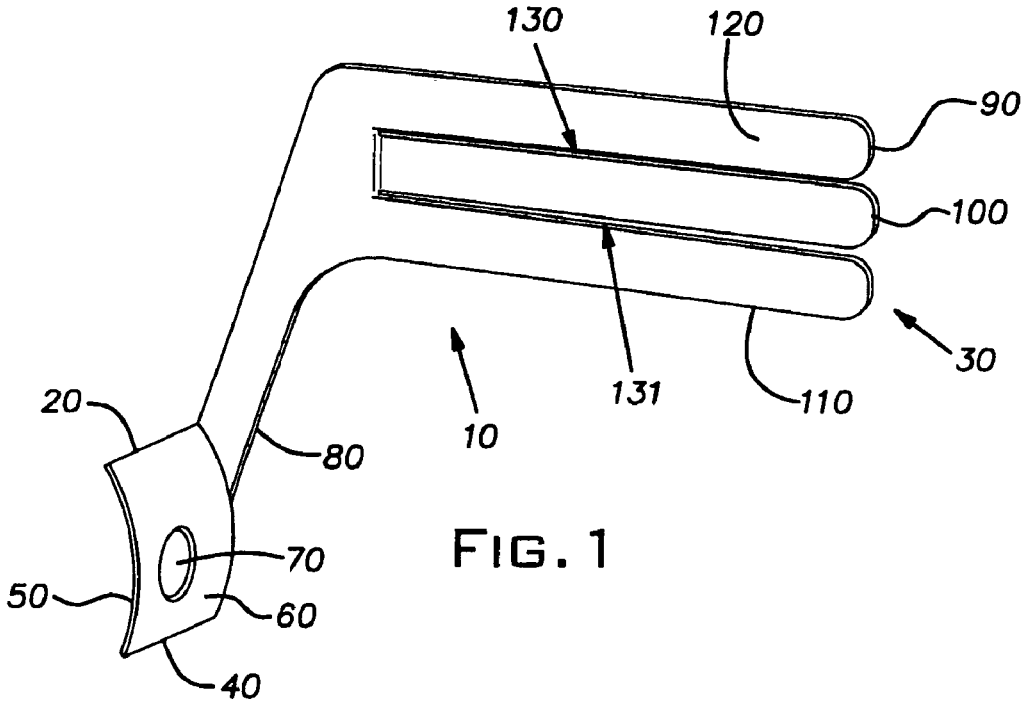
FIG. 1 is a perspective view of a preferred embodiment of a recipe card holding device for attachment to a food mixer.
Figure 2:
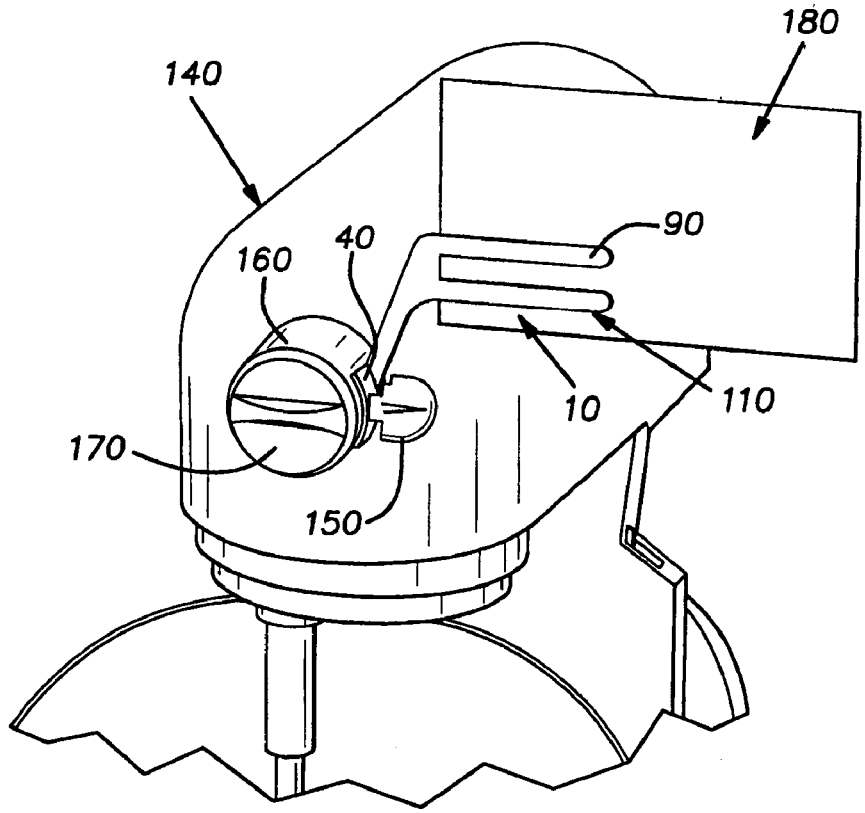
FIG. 2 is a perspective view of the recipe card holding device shown in FIG. 1 attached to a food mixer.

The present invention provides a kitchen appliance comprising a food mixer and an attached recipe card holding device. With reference to FIG. 1, the recipe card holding device 10 preferably comprises a first end 20 and a second end 30. The first end 20 preferably comprises a mounting portion 40 having a first side 50 and a second side 60. With reference to FIG. 2, the first side 50 of the mounting portion 40 is configured to contact the housing 160 of a food mixer 140. An opening 70 is provided in the mounting portion 40 through which an accessory mounting screw 150 is passed. The accessory mounting screw 150 threads into a threaded aperture in the food mixer 140 and makes contact with the second side 60 of the mounting portion 40 to secure the recipe card holding device 10 to the food mixer 140.

An arm 80 extends between and connects the first end 20 of the recipe card holding device 10 to the second end 30. The second end 30 preferably terminates in a top finger 90, a middle finger 100, and a bottom finger 110, each of which extends generally parallel to each other. Top and bottom slots 130, 131 extend between the fingers 90, 100, 110. The front surface 120 of top finger 90 and bottom finger 110 can optionally be provided with a high friction material, such as rubber, to help grip a recipe card 180, which is woven between the fingers 90, 100 and 110.

In the presently most preferred embodiment of the invention, the food mixer 140 is a stand mixer such as sold by the Whirlpool Corporation under the KITCHENAID® mark. Stand mixers of this type come in several sizes and configurations. In some models, the head portion of the mixer tilts away from the mixing bowl. In other models, the head portion of the mixer is stationary and the mixing bowl is lifted up to the mixing blades. Both types of stand mixers feature a housing 160 that covers the head portion of the food mixer 140.

In a preferred first embodiment of the invention, the recipe card holding device 10 is attached to the food mixer 140 using the accessory mounting screw 150. To attach the recipe card holding device 10 to the food mixer 140, a user first unscrews and removes the accessory mounting screw 150 from the food mixer 140. The first side 50 of the mounting portion 40 is then positioned in contact with the housing 160 of the food mixer adjacent to the power take off 170. The opening 70 in the mounting portion 40 is aligned such that the accessory mounting screw 150 passes through the opening 70 and threads back into an aperture in the food mixer 140. The head of the accessory mounting screw 150 contacts the second side 60 of the mounting portion 40 to secure the recipe card holding device 10 to the food mixer 140. The recipe card holding device 10 does not interfere with many accessories that can be attached to the food mixer 140.

Preferably, the mounting portion 40 preferably has a smaller radius than the radius of the outer surface of the housing 160 of the food mixer 140. Thus, the mounting portion 40 provides a spring force against the accessory mounting screw 150, which is not configured to bottom out against the power take off housing 160. The spring force prevents the recipe card holding device from wobbling during operation of the food mixer 140.

To use the recipe card holding device, a user sequentially threads or weaves a recipe card 180 behind the top finger 90, through the top slot 130, in front of the middle finger 100, through the bottom slot 131 and behind the bottom finger 110. The friction provided by the fingers 90, 100, 110 and the stiffness of the recipe card 180 cooperate to hold the recipe card 180 in place. The recipe card 180 is thus easily viewed during preparation of a food item.

Figure 3:
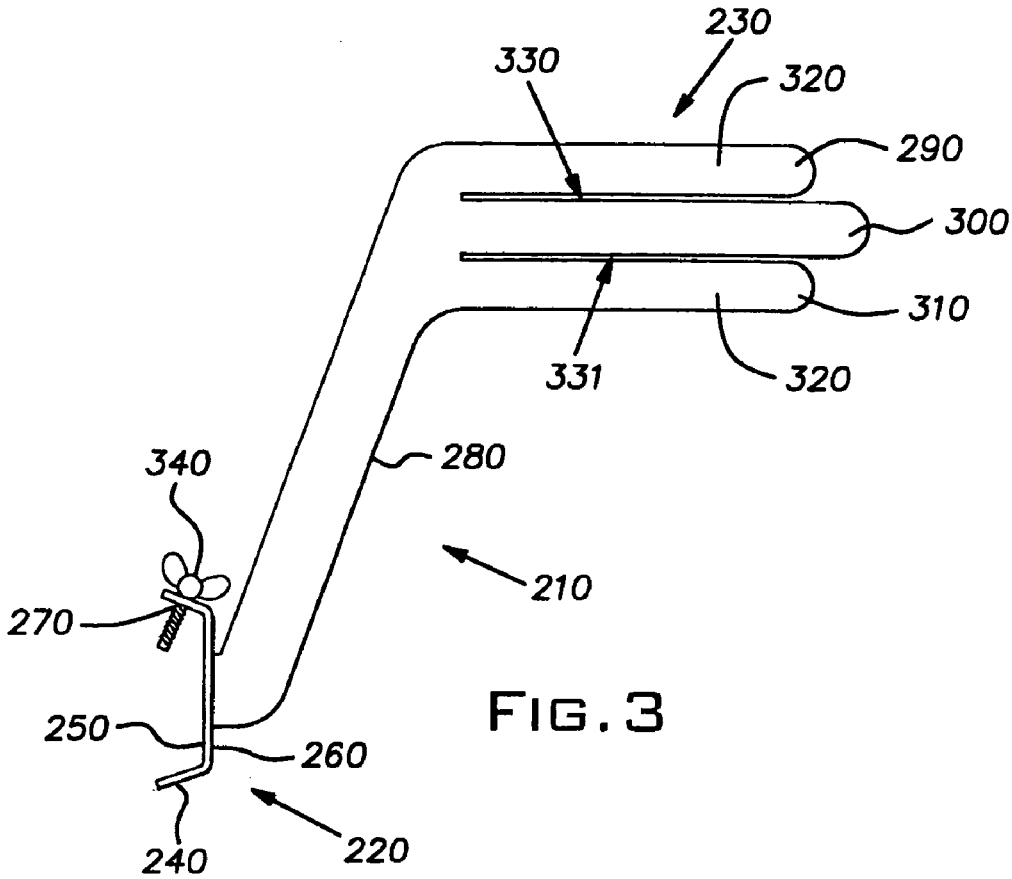
FIG. 3 is a front view of an alternative embodiment of a recipe card holding device for attachment to a food mixer.

It will be appreciated that the recipe card holding device 10 can be configured to attach to a variety of different food mixers simply by varying the means of mounting the device to the food mixer. For example, in a second embodiment of a recipe card holding device 210 shown in FIG. 3, the mounting portion 240 is generally C-shaped at the first end 220 of the device 210. The mounting portion 240 adjacent the arm 280 includes a first side 250 that is shaped to contact the housing of a food mixer other than at the power take off. The mounting portion 240 is provided with an opening 270 sized to allow the threaded portion of a wing screw 340 or other finger-tightenable fastener to pass through. The wing-screw 340 threads into an aperture in the housing of the food mixer to secure the recipe card holding device to the food mixer. The device 210 also comprises a top finger 290, a middle finger 300 and a bottom finger 310 at a second end 230, and a top slot 330 and a bottom slot 331 between the fingers 290, 300 and 310. A user can thread or weave a recipe card 180 (not shown) in front of the top finger 290, through the top slot 330, behind the middle finger 300, through the bottom slot 331, and in front of the bottom finger 310. Thus, only one finger 300 covers a front portion of the recipe card.

It will be appreciated that other means of holding a recipe card can be used. For example, the holding means could comprise of a spring clip or a stand having a lower edge against which a recipe card can rest. Virtually any means by which the second end of the recipe card holding device secures a recipe card in view of a user can be used.

Figure 4:
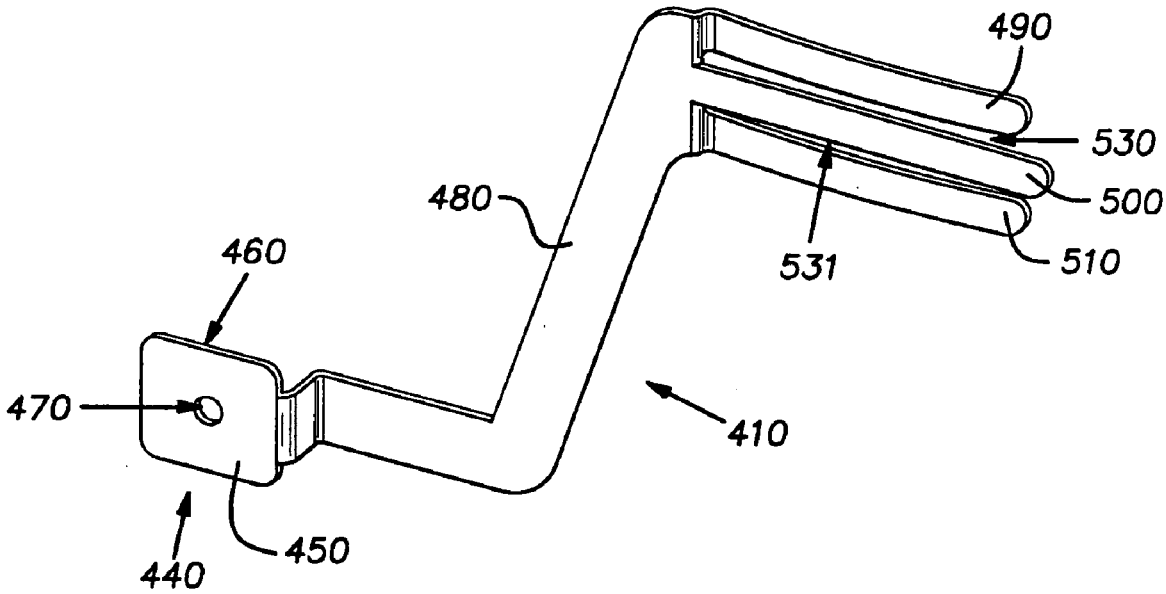
FIG. 4 is a perspective view of yet another alternative embodiment of a recipe card holding device for attachment to a food mixer.
Figure 5:
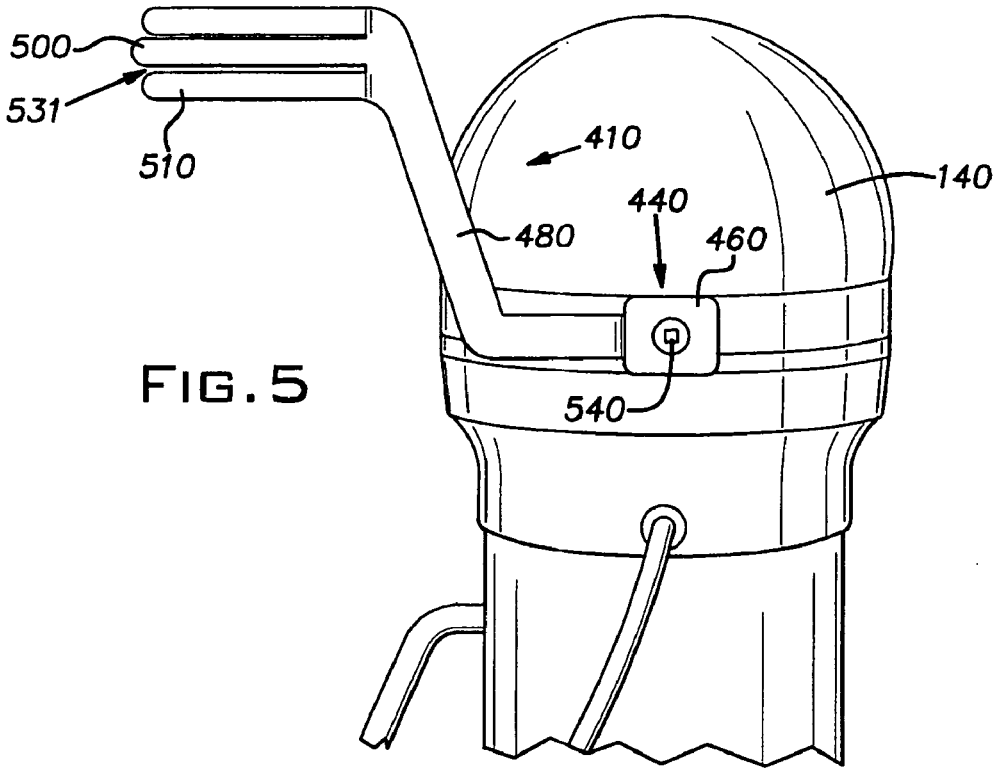
FIG. 5 is a rear view of a food mixer having a recipe card holding device such as shown in FIG. 4 attached thereto.
Figure 6:
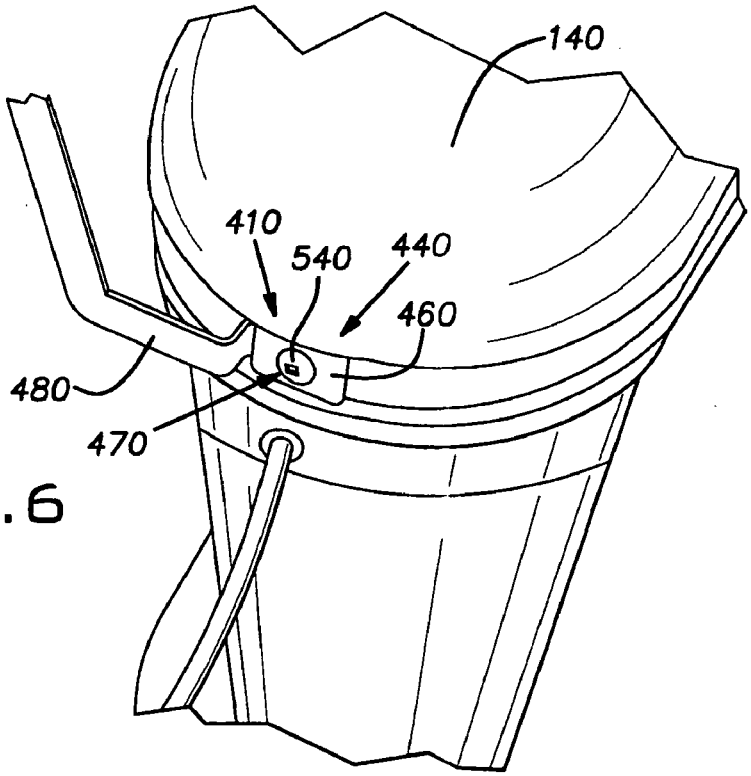
FIG. 6 is a perspective view of a portion of the food mixer and recipe card holding device shown in FIG. 5.
Figure 7:
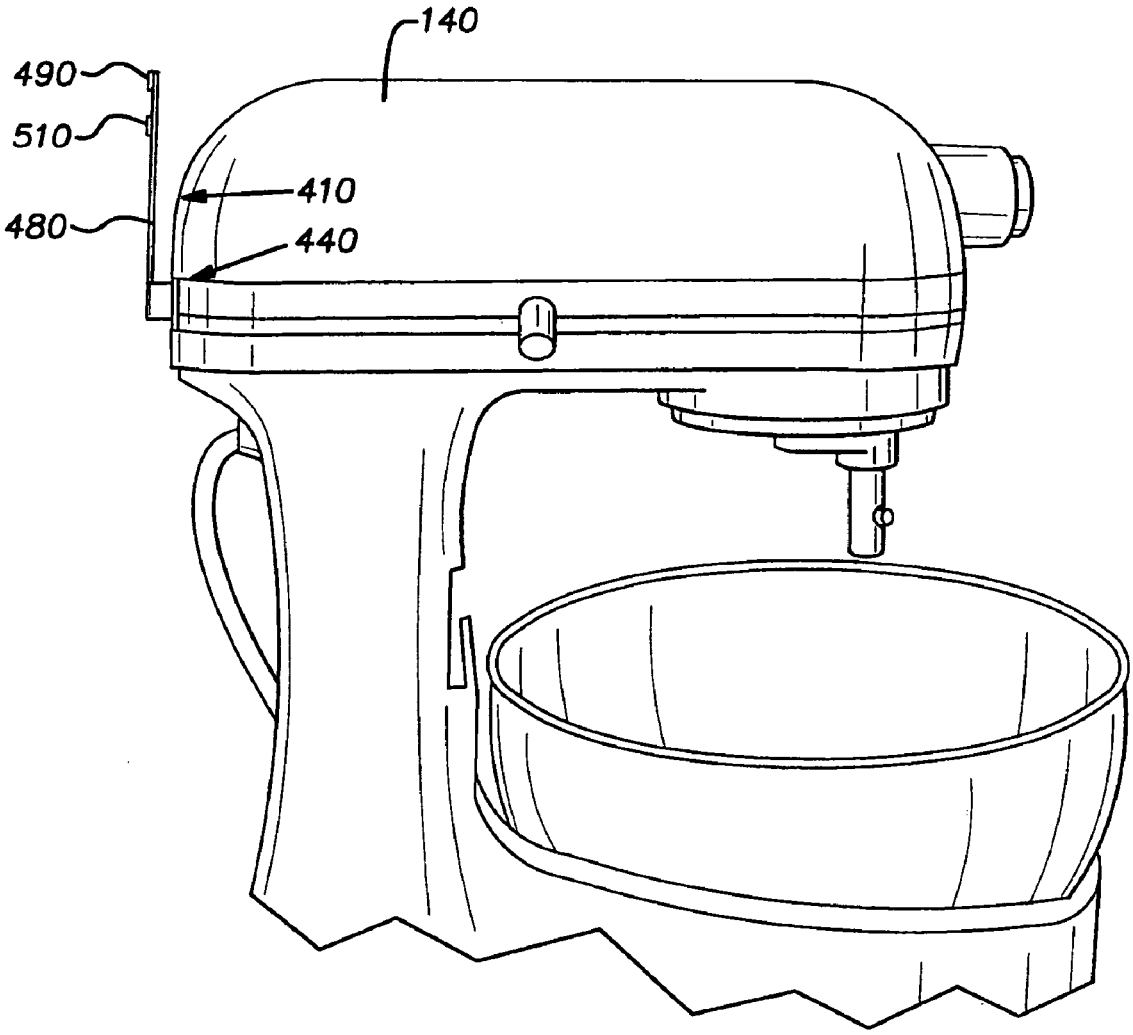
FIG. 7 is a side view of the food mixer and recipe card holding device shown in FIG. 5.

FIG. 4 shows a third embodiment of a recipe card holding device 410. In this embodiment, the mounting portion 440 is configured to attach to a rear side of the food mixer, opposite the power take off housing. FIGS. 5–7 provide several views of a recipe card holding device 410 such as shown in FIG. 4 attached to a rear side of a food mixer 140. This point of attachment for the recipe card holding device 410 is preferred for use on food mixers that feature a bowl that lifts upwardly toward the mixing element(s) (e.g., beaters), as opposed to food mixers that feature a tilting head portion.

In the embodiment of the recipe carding holding device shown in FIG. 4, the generally planar mounting portion 440 is provided with an opening 470. The mounting portion 440 has a first side 450 that contacts the housing 160 of the food mixer 140. When the device 410 is mounted to the food mixer 140, as illustrated in FIGS. 5, 6 and 7, a mounting screw 540 having a head with a diameter that is larger than the opening 470 is inserted through the opening 470 and into a threaded portion of the housing of the food mixer 140 so that the head of the mounting screw 540 contacts the second side 460 of the mounting portion 440 and secures the device 410 to the food mixer 140.

The recipe card holding device 410 shown in FIGS. 4–7 comprises a top finger 490, a middle finger 500 and a bottom finger 510. A top slot 530 is disposed between the top finger 490 and the middle finger 500. A bottom slot 531 is disposed between the middle finger 500 and the bottom finger 510. A side view of the device 410 mounted to a food mixer 140 is illustrated in FIG. 7. The top finger 490, the middle finger 500, and the bottom finger 510 are generally oriented parallel to one another. However, as shown in the side view in FIG. 7, and in FIG. 4, the top finger 490 and the bottom finger 510 are in a plane that is slightly offset from a plane defined by middle finger 500. Thus, a recipe card may be inserted in front of the top finger 490, through the top slot 530, behind the middle finger 500, through the bottom slot 531, and in front of the bottom finger 510. Only the middle finger 500 covers the recipe card in this third embodiment, similar to the second embodiment.

As previously noted, the means of mounting the recipe card holding device to the food mixer is not per se critical, and a variety of means can be employed. For example, the mounting portion can slide into a receiving slot provided in the housing of a food mixer. Alternatively, a magnet could be provided at the first end for magnetically attaching the recipe card holding device to the food mixer. Virtually any means by which the first end of the device is secured to the food mixer can be used.

In the presently most preferred embodiment of the invention, the recipe card holding device is formed of metal and is shaped by stamping or other metal working means. Alternatively, the recipe card holding device can be formed of a substantially rigid polymer, such as polycarbonate, which is both transparent and strong. The surface of the recipe card holding device can be provided with high friction materials such as rubber or can be textured (e.g., by sandblasting) to provide higher friction.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A kitchen appliance comprising:

an electric stand-type food mixer having a housing; and a recipe card holding device attached to the housing; wherein the recipe card holding device comprises:

a first end configured for attachment to the housing of the electric stand mixer;

a second end comprising means for holding a recipe card; and an arm portion that extends between the first end and the second end, wherein the first end of the recipe card holding device compromises a mounting portion having a first side for contacting the housing of the electric stand-type food mixer, a second side for contacting a head of a mounting screw that passes through an opening formed in the mounting portion and is received in an aperture in the housing of the electric stand-type food mixer.

2. The kitchen appliance according to claim 1 wherein the first side of the mounting portion contacts the housing of the electric stand-type food mixer at a power take off.

3. The kitchen appliance according to claim 2, wherein the radius of the first side of the mounting portion of the recipe card holding device is smaller than the radius of the housing of the electric stand-type food mixer.

4. A method of attaching a recipe card holding device to a housing of an electric stand-type food mixer compromising:

removing an accessory mounting screw from an aperture formed in the housing of the electric stand-type food mixer at a power take off;

positioning a first side of a mounting portion of the recipe card holding device in contact with the housing of the electric stand-type food mixer at the power take off;

passing a threaded portion of the accessory mounting screw through an opening formed in the first end of the recipe card holding device and into the aperture formed in the housing of the electric stand-type food mixer; and tightening the accessory mounting screw.

5. The method according to claim 4 wherein the first side of the mounting portion of the recipe card holding device has a smaller radius than the housing of the electric stan-type food mixer at the power take off and the mounting portion provides a spring force during the tightening step.

* * * * *